US007963301B2

(12) United States Patent
Stauss et al.

(10) Patent No.: US 7,963,301 B2
(45) Date of Patent: Jun. 21, 2011

(54) JACQUARD HEALD WITH EMBOSSED THREAD EYE REGION

(75) Inventors: Jochen Stauss, Winterlingen (DE); Werner Veeser, Nusplingen (DE); Rene Conzelmann, Burladingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/565,617

(22) Filed: Sep. 23, 2009

(65) Prior Publication Data

US 2010/0084040 A1 Apr. 8, 2010

(30) Foreign Application Priority Data

Sep. 23, 2008 (EP) ..... 08164922

(51) Int. Cl.
*D03C 9/02* (2006.01)
*D03C 9/04* (2006.01)
*D03C 13/00* (2006.01)

(52) U.S. Cl. ..... 139/93; 139/35; 139/94; 139/95; 139/96

(58) Field of Classification Search ..... 139/35, 139/52, 53, 93–96
See application file for complete search history.

(56) References Cited

U.S. PATENT DOCUMENTS

| | | | | |
|---|---|---|---|---|
| 569,149 | A | 10/1896 | Draper | |
| 2,132,245 | A * | 10/1938 | Royle | 139/94 |
| 3,088,496 | A * | 5/1963 | Houghton et al. | 139/92 |
| 3,628,574 | A | 12/1971 | Ramseier | |
| 4,155,379 | A * | 5/1979 | Graf | 139/93 |
| 5,052,446 | A * | 10/1991 | Gysin | 139/93 |
| 5,598,233 | A * | 1/1997 | Haralambopoulos et al. | 351/160 H |
| 6,283,163 | B1 | 9/2001 | Kagi | |
| 7,017,620 | B2 * | 3/2006 | Mettler et al. | 139/93 |
| 7,036,532 | B2 * | 5/2006 | Bauder et al. | 139/52 |
| 7,281,548 | B2 * | 10/2007 | Schmid et al. | 139/93 |
| 7,469,723 | B2 | 12/2008 | Himmelstoss | |
| 2005/0016613 | A1 * | 1/2005 | Mettler et al. | 139/93 |
| 2005/0087252 | A1 * | 4/2005 | Mettler | 139/92 |
| 2006/0011252 | A1 * | 1/2006 | Schmid et al. | 139/93 |
| 2007/0000552 | A1 * | 1/2007 | Mettler et al. | 139/52 |
| 2007/0131301 | A1 * | 6/2007 | Mettler | 139/52 |
| 2008/0083471 | A1 * | 4/2008 | Mettler | 139/93 |

FOREIGN PATENT DOCUMENTS

| | | |
|---|---|---|
| DE | 121 105 C | 7/1901 |
| DE | 19 50 903 A1 | 4/1970 |
| EP | 0947620 | 10/1999 |
| EP | 1015675 | 7/2000 |
| EP | 1252944 | 10/2002 |
| EP | 1767676 | 3/2007 |
| GB | 807945 | 1/1959 |
| JP | 57-117646 | 7/1982 |

* cited by examiner

*Primary Examiner* — Bobby H Muromoto, Jr.
(74) *Attorney, Agent, or Firm* — Fitch, Even, Tabin & Flannery; Norman N. Kunitz

(57) ABSTRACT

A heald body fabricated of a round wire and having a round shank with a flattened intermediate or center section (9) that is provided with a widened opening (16) delimited by two legs (14, 15). The area (A1) of the round cross section of the shank (20) substantially corresponds to the sum of the cross sectional areas (A5, A6) of the two legs (14, 15) of the intermediate section, whereby the heald body has a substantially constant cross-sectional area along its length.

14 Claims, 4 Drawing Sheets

JACQUARD HEALD WITH EMBOSSED THREAD EYE REGION

CROSS-REFERENCE TO RELATED APPLICATION

This application claims the benefit of foreign priority under 35 U.S.C. §119 based on European 08 164 922.0, filed Sep. 23, 2008, the entire disclosure of which application is hereby incorporated by reference.

BACKGROUND OF THE INVENTION

The invention relates to a Jacquard heald for use in Jacquard machines.

In accordance with document GB 807945 Jacquard healds are manufactured, for example, in that two adjacent wires are initially soldered together. The soldered-together wires are then separated again in one region and are slightly bent apart. Then a thread eye insert (maillon) is soldered into the thusly formed opening, said insert forming the thread eye.

A similar procedure has been known from document EP 1 015 675 B1. Again, initially, two wires are used that are firmly connected to each other by being tin-plated or nickel-plated. In one region, the wires are detached from each other and bent away from each other in order to insert a thread eye insert. An adhesive is then used to secure the latter in place between the wires.

It is true that, due to this measure, it is no longer necessary to solder the thread eye inserts in place, however, the previous manufacture of the twin wire is still required.

In order to avoid this disadvantage, it has been suggested, for example in EP 1 252 944, to use a profiled wire instead of the twin wire as the starting material, said profiled wire have an approximately octagonal cross-section. However, such profiled wires are generally not commercially available.

The considerably older document U.S. Pat. No. 569,149 A discloses the manufacture of healds from round wire, in which case, a central region is converted into a flat shape by plastic reformation in order to produce the thread eye. Then, the thread eye is punched into this region. This procedure results in a significant weakening of the tensile strength of the heald at the thread eye.

This is remedied by document DE 121 105 which uses a relatively thick wire for the manufacture of the heald. While a central region of the wire remains initially without deformation, the two axially adjoining sections are elongated in axial direction so that their diameter decreases. The remaining thick central section is then flattened to a thickness that corresponds to the diameter of the elongated regions. Then, again, an oval opening is punched into the resultant oval flattened region, whereby a thread eye insert can be placed in said opening.

This process is tedious. The elongation of the wire is little suitable for mass production.

Another approach can be learned from document EP 0 947 620. There, the suggestion has been made to start with a ribbon in which a narrow opening is applied and then widened in order to apply a thread eye insert. Inasmuch as the thread eye inserts have a thickness starting at approximately 0.35 mm, such a heald has a relatively large ribbon cross-section. Consequently, the heald becomes relatively heavy, this being undesirable in view of the fact that the heald movements are controlled by springs.

Document EP 1 767 676 represents a supplement to the aforementioned publication, as it were, disclosing the improvement of the fastening options for the thread eye insert.

Document DE 195 09 03 suggests the use of a round wire as the starting material instead of a flat ribbon, said wire being rolled flat during a first manufacturing step. As a result of this, rounded lateral edges are formed next to the two flat sides formed by the rollers. Longitudinally extending notches are then embossed in the flat sides of the flattened wire, at which notches the heald can be easily split in order to apply a thread eye insert.

A completely different direction is taken by document JPS 57-117646. The heald shown there starts with a round wire to which a flattened region is applied. An opening is embossed in said region, said opening being delimited by two remaining flat legs. The opening is narrower than a thread eye that is to be inserted. In order to achieve the necessary width, the remaining legs are twisted in longitudinal direction so that their cross-section is diagonal to the thread eye. The resultant asymmetrical form is particularly disadvantageous during the weaving operation, in particular considering the thread that is sliding past the heald.

It is the object of the present invention to provide a Jacquard heald that can be manufactured in a cost-effective manner without compromising the quality. The above-described disadvantages are to be avoided as much as possible.

SUMMARY OF THE INVENTION

The above object generally is achieved with the Jacquard heald in accordance with the invention that comprises a heald body that consists of a round material. The latter is provided with a flattened section that has a widened opening delimited by two legs. Together, the two legs have a cross-sectional area that corresponds to the cross-sectional area of the round heald body. Consequently, the tensile strength of the heald in the flattened section and in the region of the eye, is approximately as large as in the regions at a distance from the eye. In addition, the starting material used for the manufacture of the heald may be round wire that is available as a cost-effective semi-finished product. Manufacturing steps that are difficult to control and thus also cause manufacturing defects such as, for example, the local elongation of the wire, are avoided. In addition, the (round-wire) heald is narrow, so that it is barely worn by the warp threads that pass between the healds. The useful life is correspondingly long. Jacquard heald replacements that are particularly labor-intensive can be reduced to a minimum.

The width of the inventive Jacquard heald that is small compared with flat ribbon healds or double-wire healds also permits the production of comparatively dense Jacquard fabrics.

The Jacquard heald in accordance with the invention is preferably symmetrical relative to the center plane, with the opening direction of the thread eye being perpendicular to said plane. The front side and the rear side of the Jacquard heald are the same, in particular at the thread eye. This is gentle on the warp threads.

In addition, the healds in accordance with the invention can be optimized regarding their weight. Due to the largely constant material cross-section in longitudinal direction and the resultant constant tensile strength, the weaving heald can be manufactured along its entire length with a minimum use of material. In view of the conditions occurring in Jacquard machines, this is advantageous. As a rule, a negative shed formation occurs in Jacquard machines. This means that the healds are held by springs or weights in the lower shed position and are moved by the pulling force of the respective harness cord into the upper shed position. The lighter the healds are, the smaller is the force required for this. Also, the counter-force may be correspondingly lower, i.e., the weights or springs that pull the healds in downward direction may be correspondingly lighter or weaker. As a result of this, the power consumption of a Jacquard machine may be reduced.

The heald in accordance with the invention results in no or only very minimal material waste during manufacture, this being of particular importance when high-quality steel or stainless steel, as well as any high-grade steel, are used. The cross-sections of the legs enclosing the opening are produced by plastic reformation without (worth-mentioning) material abrasion from the cross-section of the starting material.

The heald in accordance with the invention can be produced starting with a round wire, i.e., of metal. This heald may also be manufactured of plastic material, for example, a carbon fiber or glass fiber composite material. Considering the plastic material option, the sum of the areas of the leg cross-sections corresponds to the area of the round cross-section. Depending on the manufacturing method, the sum of the areas of the cross-section of the legs may deviate minimally from the area of the round cross-section. Thus, it is possible that, during the mechanical production of the cross-sections of the legs, a material flow in longitudinal direction of the heald in accordance with the invention takes place, said flow only minimally affecting the ratios of the cross-sections. Then, the two legs together have a cross-sectional area that still largely corresponds to the cross-sectional area of the round heald body.

A thread eye insert is preferably held in the opening delimited by the two legs. Said insert may preferably be glued in. It is also possible to hold it in place by means of a solder, or by welding. Preferably, the thread eye insert has a peripheral channel on its outside circumference. The legs of the heald that are bent away from each other to fit into this channel and thus hold the thread eye insert. If the outside contour of the thread eye insert is optimally adapted to the cross-section of the legs, i.e., they are congruent with respect to each other, a fastening of the thread eye insert, e.g., by soldering or gluing, may be omitted because a positive lock is created between the outside contour of the thread eye insert and the legs.

When a thin round wire having a round cross-section is used for the manufacture of the heald, the wire cross-section is preferably prespecified in that the size of the thread eye insert is used as the starting point. The thickness of the thread eye insert determines the cross-sections of the two wire-type legs that come into engagement in the channel extending on the outside of the thread eye insert. The sum of these essentially round leg cross-sections that usually have a diameter of 0.3 to 0.4 mm results from the wire cross-section of thus, e.g., 0.42 mm to 0.57 mm. Preferably, a wire diameter of 0.5 mm is used because the legs then are imparted with a diameter of approximately 0.35 mm. This corresponds to the dimensions that fit the currently most frequently used thread eye inserts.

The heald in accordance with the invention is produced, for example, with the use of embossing molds in that a flattened region is formed on a round wire, said region having a longitudinal groove on each of the two flat sides. Preferably, the two longitudinal grooves have a matching form. Consequently, an octagonal cross-section has been created on the round wire at the affected point. Here, two legs can be separated from each other and pulled apart. An opening is created, into which a thread eye insert may be inserted. The two legs that are separated from each other then have an at least almost round cross-section, whereby the cross-section ratios in accordance with the invention are maintained. The thusly achieved form satisfies all the demands regarding the gentle handling of the thread, considering that the threads move past the outside of the healds. At the same time, fastening of the thread eye insert is easy, because the cross-sections of the legs fit into the outer groove or channel of the thread eye insert.

While the exterior form of the two legs is preferably round, the flanks facing each other may have a rib that projects into the opening, said rib engaging particularly well into the groove of the thread eye insert, so that said insert is securely held.

When the legs are spread apart, a thin strip between the legs tears, whereby the tear occurs in longitudinal direction of the heald. Transverse bores may be applied at the end of the grooves or in the vicinity of the ends, said bores acting as rip-stops when the legs are being spread apart.

By fastening the thread eye insert using a gluing technique, a material that can be soldered only with difficulty or not at all such as, for example, stainless steel, can be used as starting material for the heald. In addition, adhesive used as fastening material adds less to the weight of the heald than a corresponding solder.

Preferably, the transition between the flat cross-section and the round cross-section is achieved by a continuous transition zone, in which the individual cross-sections continuously change along the axial direction of the weaving heald. Any abrupt or step-like cross-sectional changes are preferably avoided.

Considering a preferred embodiment of the Jacquard weaving heald, the heald body is provided only on one of its two ends with an eyelet, whereas the other end preferably is provided with an anchoring element for fastening a spring, for example, a helical tensions spring. Preferably, the eyelet is formed by a hairpin-type wire loop, whereby one wire section of said wire loop is welded to the heald body by one or more welding spots, connected to said heald body by a welding seam or secured to said heald body by other means. Preferably, one section of a wire leg and one section of a heald body are arranged parallel and in contact with each other in the connecting region, for example, between the welding spots.

The anchoring element for the tension spring is preferably a plastic component that can be secured on an appropriately profiled end of the heald body in a material-locking and positive-locking manner, said end being corrugated by being bent, for example. The anchoring element, for example, has a threaded dog whose thread is suitable to accommodate the convolutions of a helical spring.

Additional details of advantageous embodiments of the invention are the subject matter of the description, the drawings or the claims. The description is restricted to essential aspects of the invention and to miscellaneous situations. The drawings are to be used for supplementary reference.

DETAILED DESCRIPTION OF THE INVENTION

Figures 1, 2, 3, 4, 5, 6, 7:
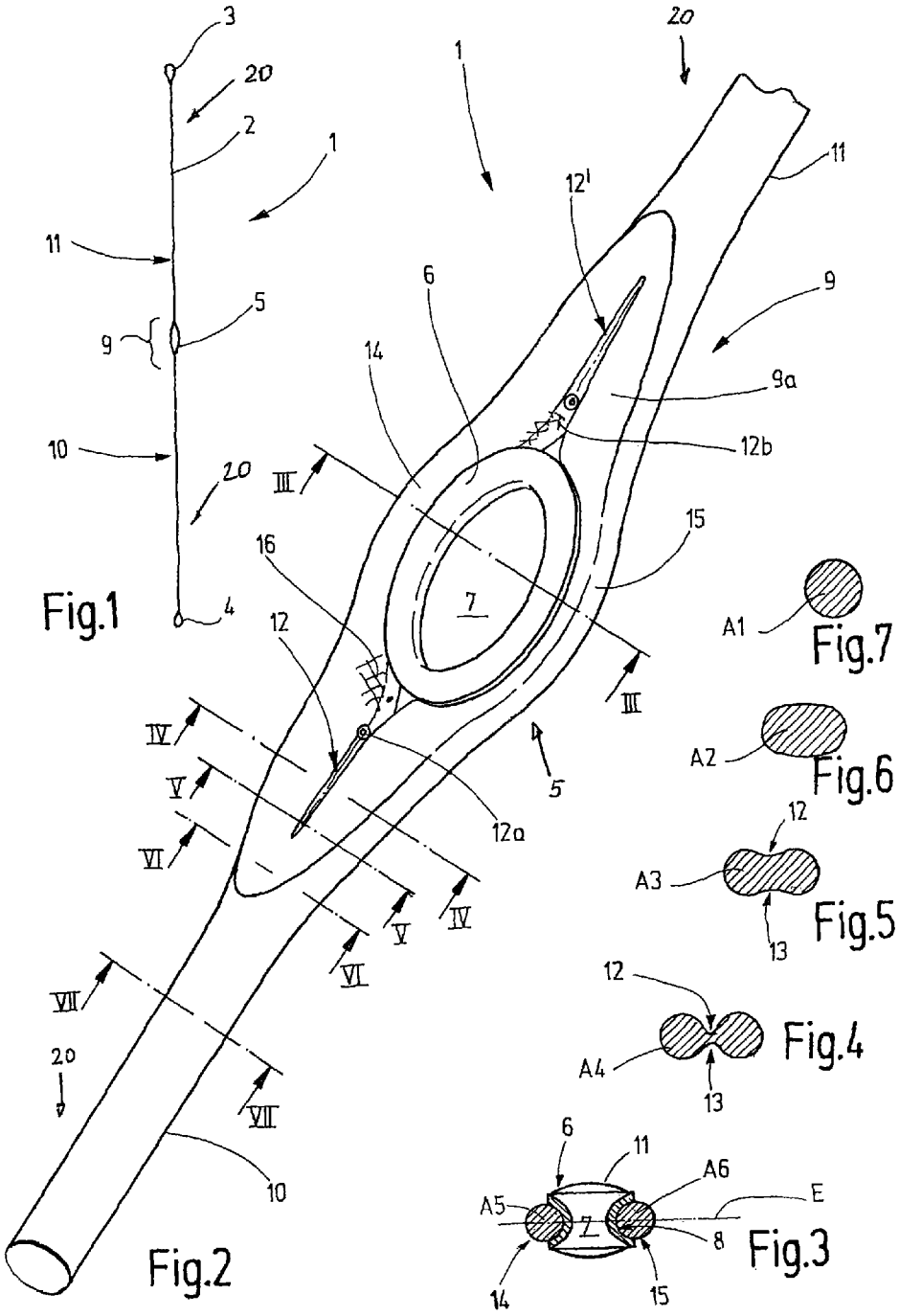
FIG. 1 is an illustration of a rough overview of a Jacquard weaving heald in accordance with the invention.
FIG. 2 is a perspective view of a detail of the Jacquard weaving heald in accordance with FIG. 1.
FIGS. 3 through 7 are cross-sections, at various points, of the Jacquard weaving heald in accordance with FIG. 2.

FIG. 1 shows a Jacquard heald 1 that is intended for use in Jacquard weaving machines. This heald comprises an elongated heald body 2 being provided on its ends with fastening means, for example, in the form of eyelets 3, 4. The heald body 2, for example, consists of a wire, for example a stainless steel wire. However, it may also consist of another suitable material, for example, a plastic material.

FIG. 2 illustrates the weaving heald 1 in greater detail. This heald has a thread eye 5 that is preferably formed by a thread eye insert 6. Such a thread eye insert 6 is also referred to as a "maillon". It is ring-shaped element that consists, for example, of hardened steel, ceramic, hard metal or a similar material and encloses a central opening 7. On its outside circumference, the thread eye insert 6 is provided with a peripheral groove or channel 8, as is obvious from FIG. 3.

In order to accommodate the thread eye insert 6, the heald body is flattened in a section 9. FIG. 2 shows section 9 only. Starting with a circular cross-section of the shank legs 10, 11 extending away from section 9, the cross-section of the shank leg 10, 11 gradually terminates in a flat cross-section over an intermediate section or transition section 9*a*. FIG. 7 shows the circular cross-section of the shank leg 10 that corresponds to the circular cross-section of the shank leg 11. The circular cross-section of the shank leg 10 or 11 has a cross-sectional area A1 that can be measured at the line of intersection VII-VII in FIG. 2 and that is preferably unchanged along the shank 20 of the Jacquard heald that is formed by said shank's legs 10 or 11.

Section 9 starts at a small distance from the thread eye insert 6. Here, the circular cross-section changes into a more and more flattened section. For example, the cross-section of the line of intersection VI-VI shown in FIG. 2 has the cross-sectional form as in FIG. 6. This cross-section defines a cross-sectional area A2 that, preferably, is of the same size as the cross-sectional area A1.

The flattening of the heald body may increase as it approaches the thread eye insert 6. For example, the cross-sectional form in accordance with FIG. 5 at the point V-V has a cross-sectional area A3, wherein A3 is equal to A2 is equal to A1. As is obvious, the flattened cross-section in accordance with FIG. 5 may have groove-shaped indentations 12, 13 on its upper and lower sides, whereby the depth of said indentations may steadily increase in longitudinal direction. This is shown by FIG. 4 that represents the cross-section IV-IV. In this instance, the cross-section may be approximately octagonal. Overall, said cross-section has a cross-sectional area A4, wherein, again, A4 is equal to A3 is equal to A2 is equal to A1.

By providing the cross-sectional form in accordance with FIG. 4, the legs 14, 15 in the flattened section 9 can be separated from each other and bent away from each other. In so doing, the narrow strip that separates the indentations 12, 13 from each other is split. Thus, the two legs 14, 15 delimit an opening 16 in which the thread eye insert 6 may be held. The conditions are shown in FIG. 3. Each of the two legs 14, 15 has a cross-section with a cross-sectional area A5, A6, each of these preferably having the same size. In addition, the sum of the two cross-sectional areas A5, A6 is preferably the same as that of the cross-section A4 or A3 or A2 or A1. As is further obvious from FIG. 3, the flattening on both sides of the heald body has the same configuration. Consequently, the weaving heald 1 at the thread eye is also—and in fact is—symmetrical with respect to a plane of symmetry E, said plane extending in the center through the two legs 14, 15 and through the shank legs 10, 11.

Adjoining the opening 16 are channel-like indentations 12, 13 (FIG. 8) extending across the flattened section 9 toward both shank legs 10, 11. Transverse bores 12*a*, 12*b* may be provided on both ends of the indentations or also at a certain distance from said indentations, said bores intersecting the two indentations 12, 13 and being aligned parallel to the thread eye. The diameter of the two bores 12*a*, 12*b* is preferably greater than the width of the indentations 12, 13. The bores 12*a*, 12*b* act as rip-stops when the legs 14, 15 are separated from each other. Then, as is obvious from FIG. 1 or FIG. 9, the bores 12*a*, 12*b* represent the ends of the resultant slit and prevent the tear from continuing when the legs 14, 15 are being bent apart.

Figure 8:
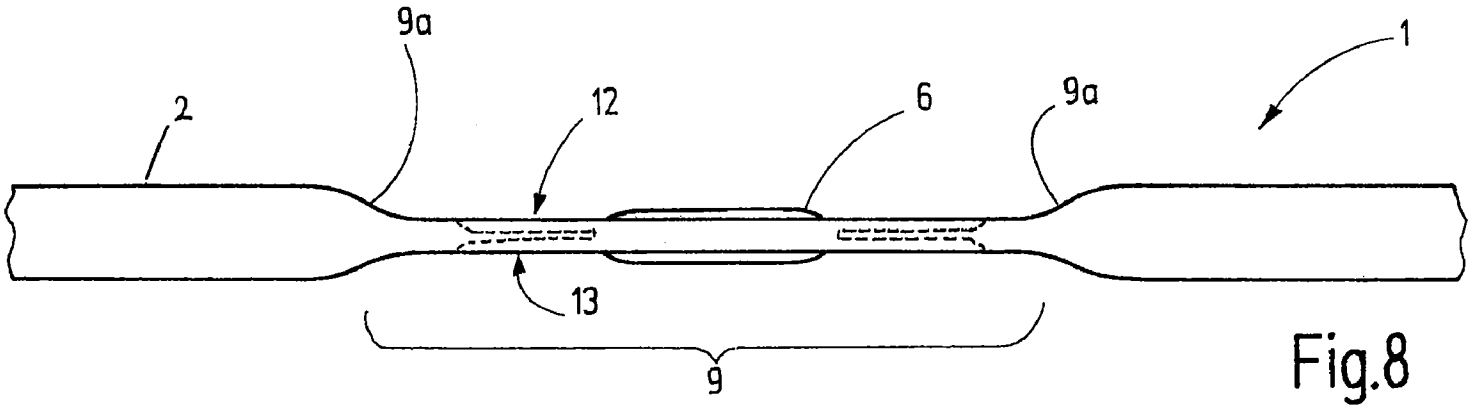
FIG. 8 is a side view of the Jacquard weaving heald in accordance with FIG. 2.
Figure 9:
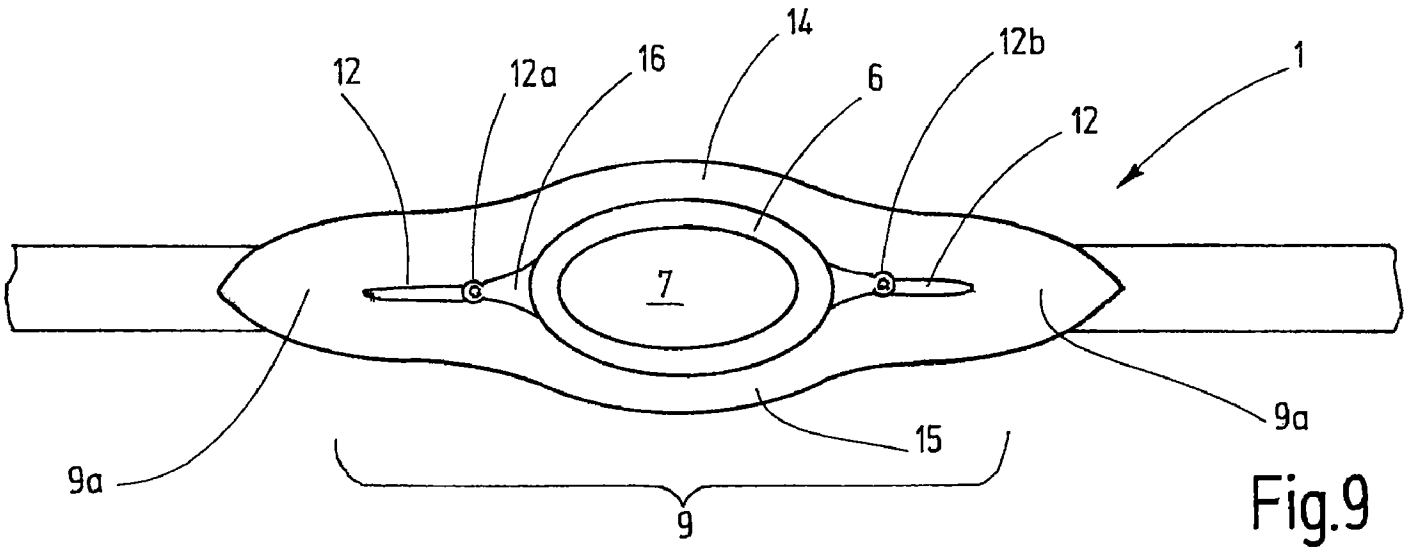
FIG. 9 is a front view of the Jacquard weaving heald in accordance with FIG. 2.

In order to further illustrate the design of the weaving heald 1, the latter is again shown in FIGS. 8 and 9. As is obvious, the heald body 2 is shaped out of a round wire in that the section 9 has been flattened and provided with longitudinally extending channel-like indentations 12, 13. In so doing, the indentation 12 on the upper side is parallel to the indentation 13 on the lower side. Wherever there are indentations 12, 13, the flattened section has the double-wire cross-section in accordance with FIG. 4. Like a two-wire heald, said cross-section can be divided into the two legs 14, 15 in order to form the opening 16. If the thread eye insert 6 is clamped between the legs 14, 15, said insert may be secured with adhesive, thus completing the manufacture of the heald 1.

Figure 10:
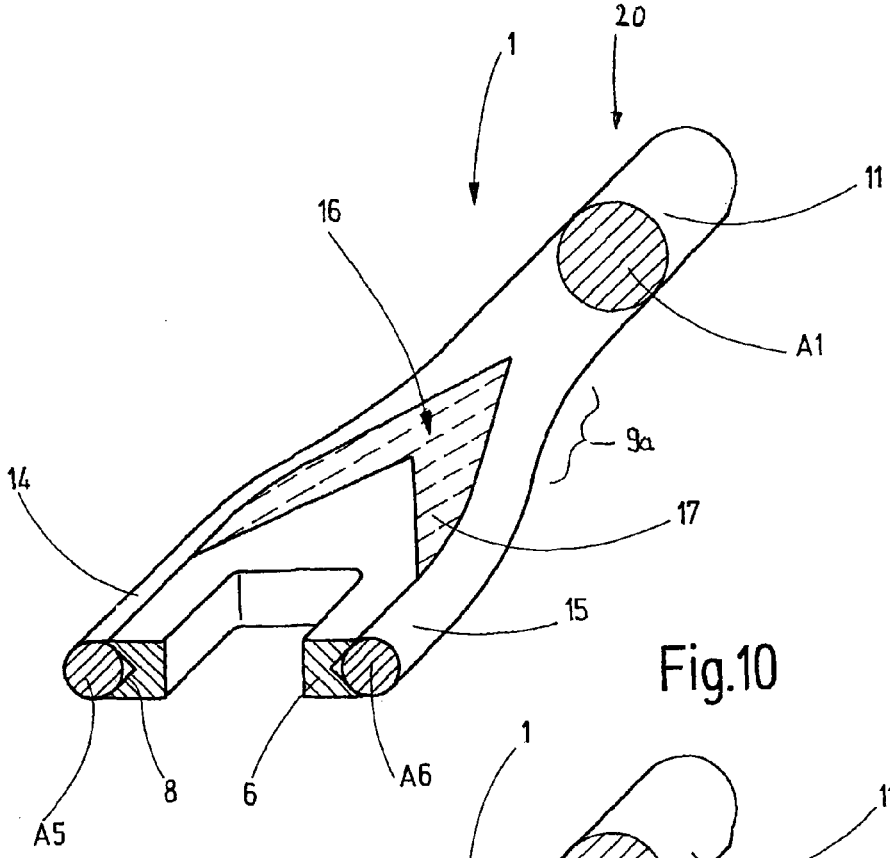
FIGS. 10 and 11 are perspective sectional views of additional embodiments of the weaving heald in accordance with the invention.
Figure 11:
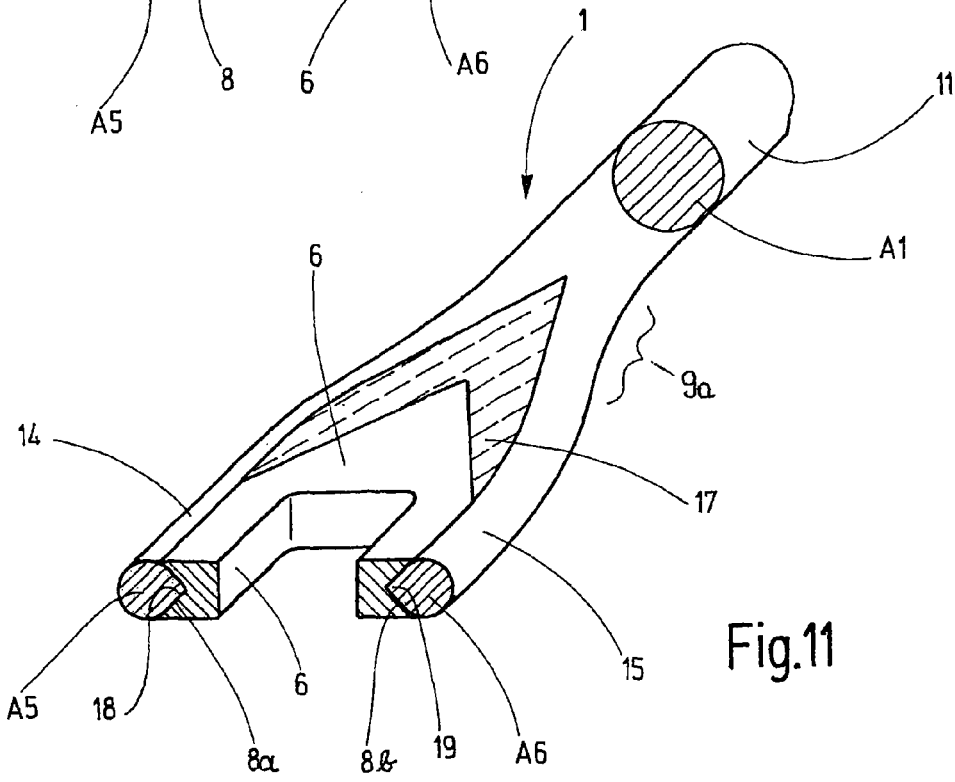

FIGS. 10 and 11 show modified embodiments of the heald 1. With the use of the same reference signs, the above description is analogously applicable. The thread eye insert 6 is configured as a rectangular ring with pointed ends. The two lateral channels 8*a* and 8*b* of said ring have flanks that are at an angle relative to each other. In order words: The channels 8*a* and 8*b* have a triangular cross-section. Referring to the embodiment in accordance with FIG. 10, each of the legs 14, 15 has a circular cross section with an A5, A6. The sum of the cross-sectional areas A5, A6, again corresponds to the cross-sectional area A1 of the cross-section of a shank shaft 10, 11. The adhesive 17 secures the thread eye insert 6 and locks the opening 16. In addition, the adhesive may penetrate into the channel 8 and hold the legs 14, 15 at the thread eye insert 6.

As shown by FIG. 11, the legs 14, 15 may also have a cross-section that is rounded on the outside and terminates inward in a pointed rib 18, 19. The sum of the cross-sectional areas A5, A6 is again as great as the cross-sectional area A1. Other than that, the above description applies analogously.

Figure 12:
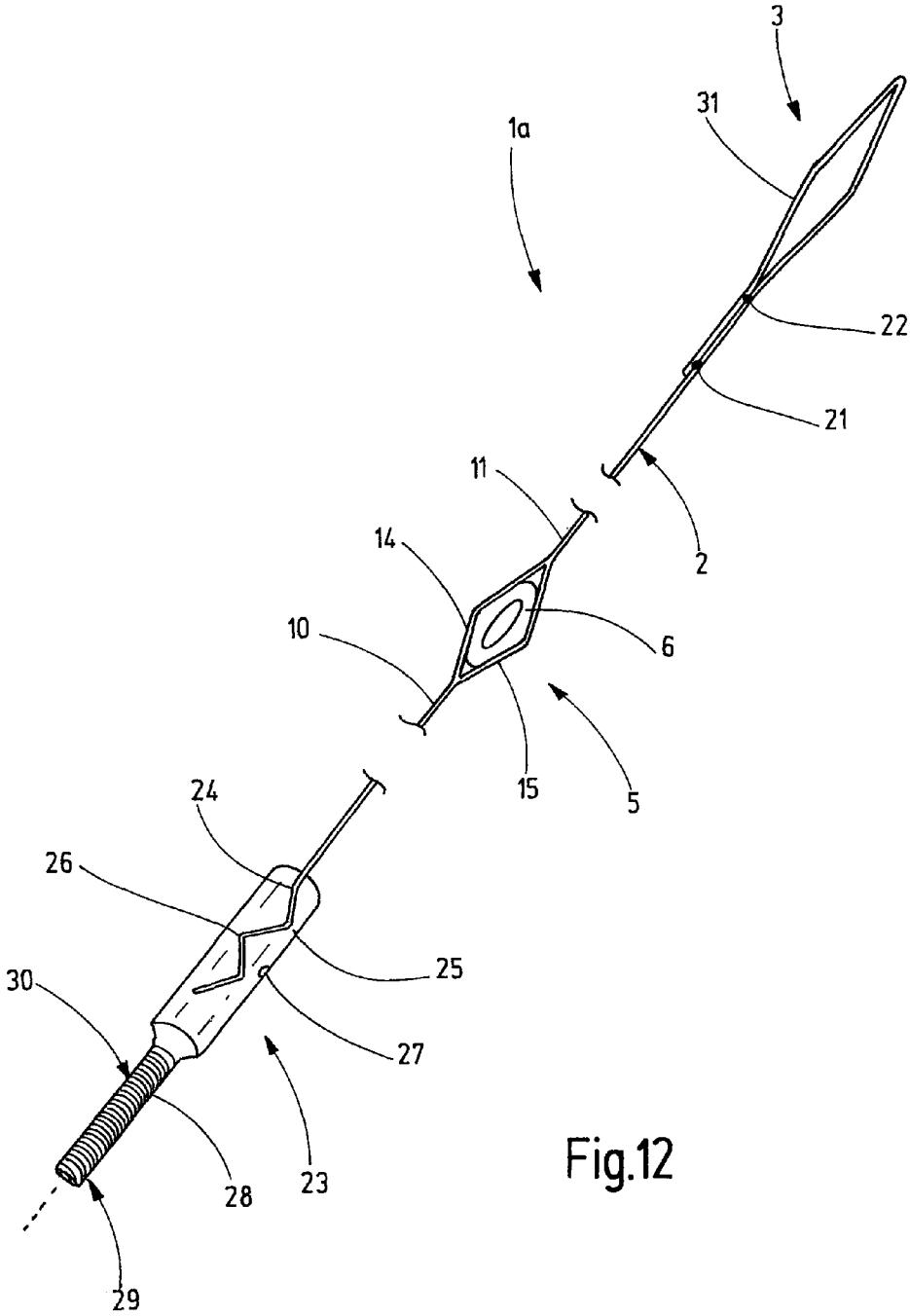
FIG. 12 is a preferred embodiment of the Jacquard weaving heald in accordance with the invention.

FIG. 12 shows a preferred embodiment of the Jacquard weaving heald 1*a*, the heald body 2 of said weaving heald being made of a metal wire. Regarding the thread eye 5, reference is made to the previous description that—using the same reference signs as basis—is preferably applicable at least also in this case. However, as is indicated by FIG. 12 the intermediate section 9*a* may be omitted. The round shank legs 10, 11 may directly terminate in the diverging legs 14, 15 that, between them, hold the maillon 6.

The heald body 1 is provided with the eyelet 3 that is created in that a wire section 31 is bent in the manner of a hairpin by approximately 180°. The end of this wire section 31 is connected—on at least one point, preferably however two points 21, 22—to the heald body 2, in particular the shank leg 11. Welding joints may be provided at the points 21, 22. Between the two points 21, 22, the end of the wire section 31 may be arranged so as to extend parallel to the shank leg 11.

Preferably, a fastening element 23 is provided on the opposite end of the heald body 2. This fastening element is, for example, an injection-molded plastic part that is connected to the end of the shank leg 10. On its one end, the shank leg 10 may be provided with one or more bends 24, 25, 26, so that said shank leg is bent, for example, in a zigzag shape or wave shape. The fastening element 23 may be an injection-molded part, for example, and circumscribe this area with a cylindrical section 27. Thus, a material-locking and/or a positive-locking connection may be accomplished.

As is obvious from FIG. 12, the fastening element 27 may have a dog-type extension 28 that is provided with a thread 30, for example, for anchoring a tension spring 29. Preferably, the extension 28 has a smaller diameter than the section 27 and is aligned concentrically with respect to said extension. Preferably, the thread is a conical thread. Preferably, the tension spring 29 is a helical tension spring of spring wire.

A heald in accordance with the invention is preferably fabricated of a round wire, said wire having a center section 9. This section has an octagonal cross-section that is defined by two legs that are connected to each other by a thin strip. In so doing, the heald body 2 may be split to accommodate a thread eye insert 6. The thread eye insert 6 is preferably secured with the use of an adhesive in the resultant opening 16.

It will be appreciated that the above description of the present invention is susceptible to various modifications and changes, and the same are intended to be comprehended within the meaning and range of equivalents of the appended claims.

LIST OF REFERENCE NUMERALS

1, 1*a* Heald, Jacquard heald
2 Heald body
3, 4 Eyelets
5 Thread eye
6 Thread eye insert/maillon
7 Opening
8, 8*a*, 8*b* Channel, groove
9 Section
9*a* Intermediate section
10, 11 Shank legs
12, 13 Indentations
12*a*, 12*b* Transverse bores
14, 15 Legs
A1-A6 Cross-sectional areas
E Center plane of symmetry
16 Opening
17 Adhesive
18, 19 Rib
20 Shank
21, 22 Points
23 Fastening element
24-26 Bends
27 Cylindrical section of the fastening element
28 Dog-type extension
29 Tension spring
30 (Screw) thread
31 Wire section

What is claimed is:

1. Jacquard heald with a heald body of a round metal wire having a round shank with a flattened section that is provided with a widened opening delimited by two legs, wherein the area (A1) of the round cross-section of the shank is equal to the sum of the areas (A5, A6) of the cross-sections of the legs, so that the body has a substantially constant cross-sectional area along its length.

2. Heald in accordance with claim 1, wherein a thread eye insert is set and secured in the opening.

3. Heald in accordance with claim 1, wherein the two legs are bent away from each other.

4. Heald in accordance with claim 1, wherein the legs are provided on their insides with a structure projecting toward the opening.

5. Heald in accordance with claim 1, wherein the legs have a rounded cross-section.

6. Heald in accordance with claim 1, wherein an unslitted flattened intermediate section is provided on at least one axial end adjoining the widened opening.

7. Heald in accordance with claim 1, wherein at least one rip-stop means is provided adjoining the opening.

8. Heald in accordance with claim 7, wherein the rip-stop means is configured in the form of at least one transverse bore.

9. Heald in accordance with claim 1, wherein respectively one continuous stepless transition is provided between the flattened section and the shank legs.

10. Heald in accordance with claim 1, wherein the opening is produced by plastic, non-cutting deformation.

11. Heald in accordance with claim 1, wherein the heald body has, at least on one end, an eyelet that is formed by a bent wire section, said wire section being fastened to the heald body by at least one weld at at least one point.

12. Heald in accordance with claim 1, wherein at least one end of the heald body is provided with at least one bend.

13. Heald in accordance with claim 12, wherein a fastening element for fastening a tension spring is arranged on the end of the heald body that is provided with the at least one bend.

14. Heald in accordance with claim 13, wherein the fastening element has an axial dog-type extension with a thread for fastening the tension spring.

* * * * *